US007518313B2

(12) United States Patent
Yamamoto et al.

(10) Patent No.: US 7,518,313 B2
(45) Date of Patent: Apr. 14, 2009

(54) DISCHARGE LAMP OF THE SHORT ARC TYPE HAVING A TRIGGER WIRE

(75) Inventors: Mayumi Yamamoto, Himeji (JP); Hiroshi Kamiyama, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 390 days.

(21) Appl. No.: 11/212,872

(22) Filed: Aug. 29, 2005

(65) Prior Publication Data

US 2006/0055327 A1 Mar. 16, 2006

(30) Foreign Application Priority Data

Sep. 10, 2004 (JP) ..... 2004-263911

(51) Int. Cl.
*H01J 11/00* (2006.01)
*H01J 61/06* (2006.01)
*H01J 65/00* (2006.01)

(52) U.S. Cl. ..... 313/607; 313/491; 313/631

(58) Field of Classification Search ..... 313/491, 313/492, 569, 594, 601, 602, 607, 631
See application file for complete search history.

(56) References Cited

U.S. PATENT DOCUMENTS 5,723,944 A * 3/1998 Higashi et al. ..... 313/570
6,002,197 A * 12/1999 Tanaka et al. ..... 313/113
6,552,502 B2 * 4/2003 Okamoto et al. ..... 315/336
6,657,383 B2 12/2003 Matsushima et al.
6,919,686 B2 * 7/2005 Okamoto et al. ..... 313/594
7,034,460 B2 * 4/2006 Takahashi et al. ..... 313/626
7,057,345 B2 * 6/2006 Kikuchi et al. ..... 313/595

FOREIGN PATENT DOCUMENTS

JP 51-78586 7/1976

* cited by examiner

*Primary Examiner*—Karabi Guharay
*Assistant Examiner*—Kevin Quarterman
(74) *Attorney, Agent, or Firm*—David S. Safran; Roberts Mlotkowski; Safran & Cole, P.C.

(57) ABSTRACT

A discharge lamp of the short arc type which has an arc tube in which there is a pair of opposed electrodes, a pair of hermetically sealing parts which extend outward from opposite ends of the arc tube, and a trigger wire, each end of which is wound around one of the hermetically sealing parts, with a middle area of the trigger wire running along the outside surface of the arc tube. In the area of at least one of the ends of the trigger wire, a bend is formed which comes to rest on one of the hermetically sealing parts, and following this bend, a fold is formed at the outer end area of the end of the trigger wire.

10 Claims, 7 Drawing Sheets

Fig. 1 (1)
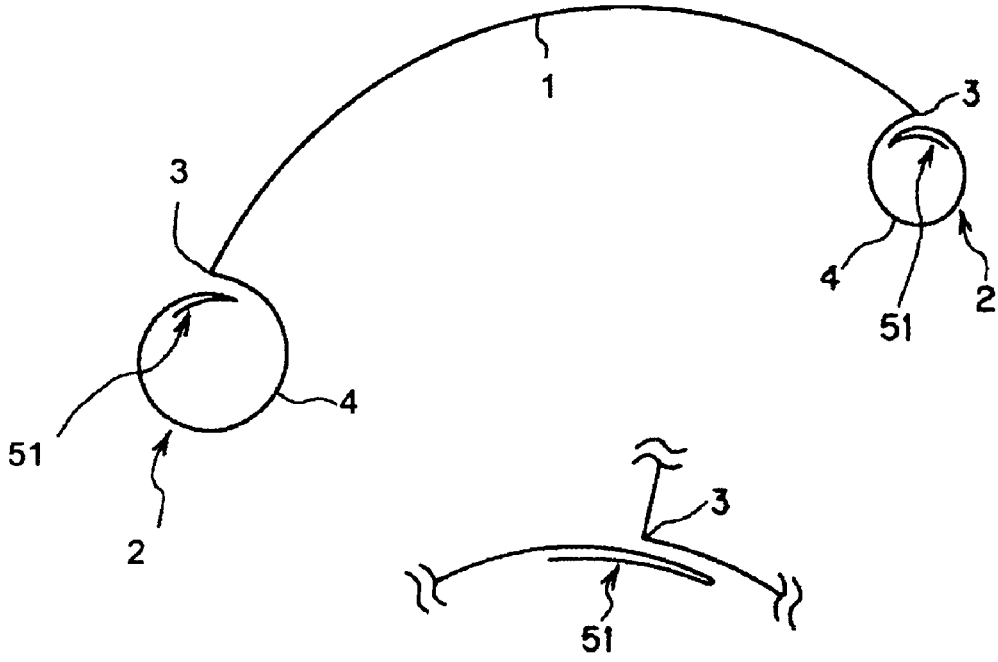
Fig. 1 (2)

Fig. 2 (1)
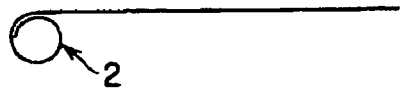
Fig. 2 (2)
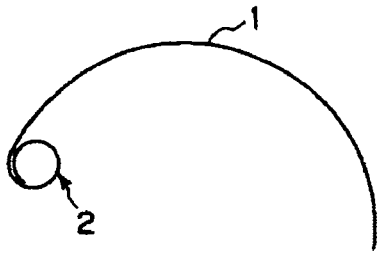
Fig. 2 (3)
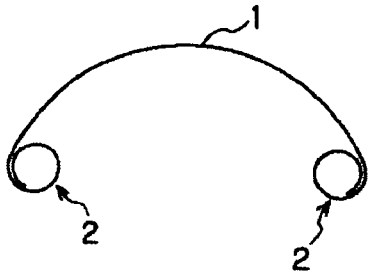
Fig. 2 (4) Heat treatment
Fig. 2 (5)
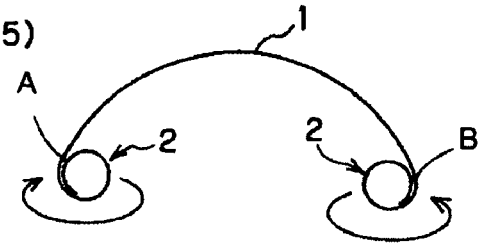
Fig. 2 (6)
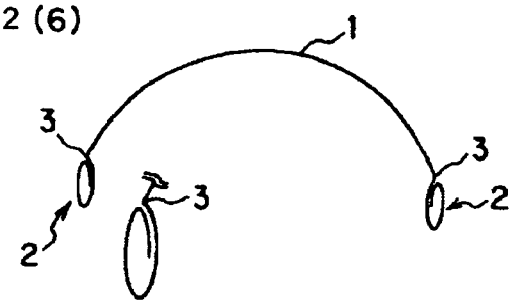
Fig. 2 (7)
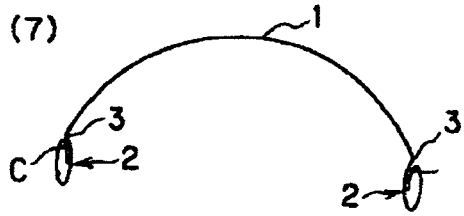
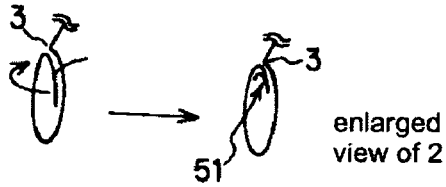
Fig. 2 (8)
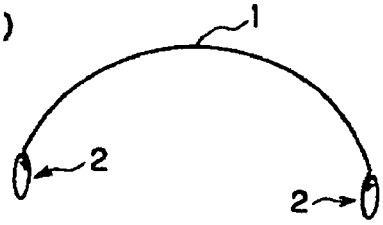

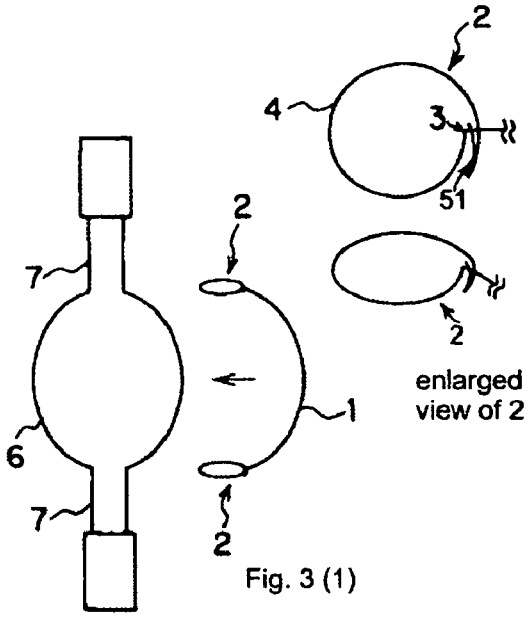
Fig. 3 (1)
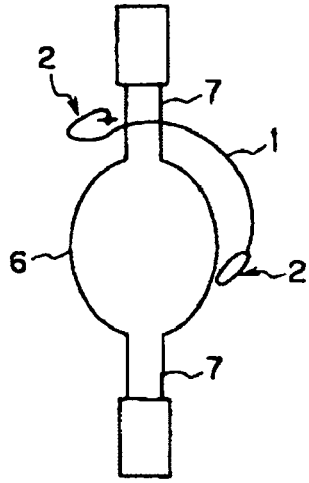
Fig. 3 (2)
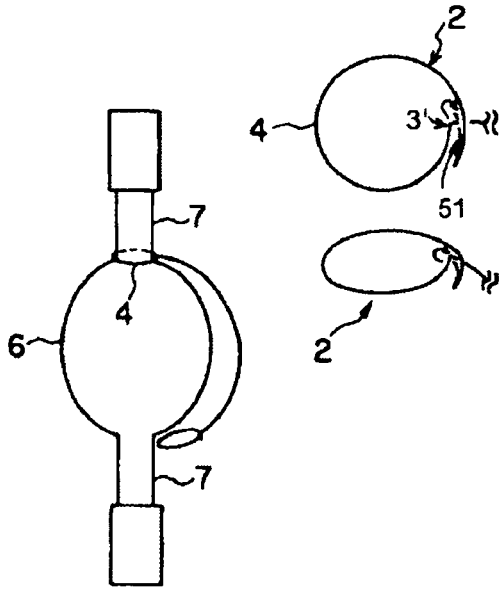
Fig. 3 (3)
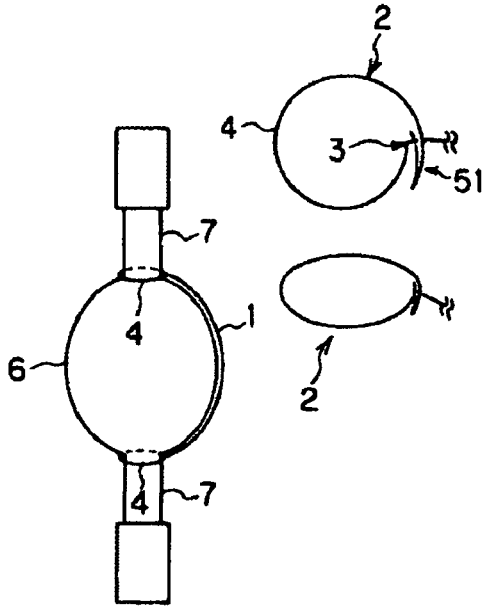
Fig. 3 (4)

Fig. 4 (1)
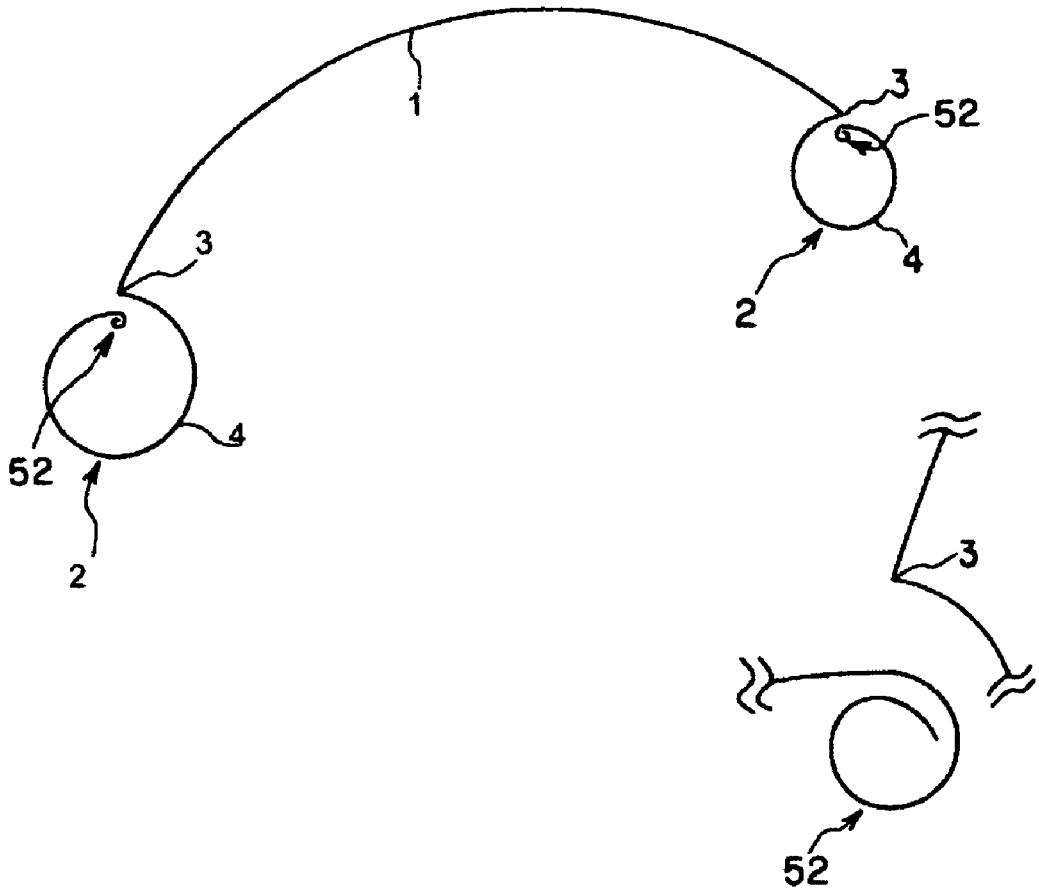
Fig. 4 (2)

Fig. 5 (1)
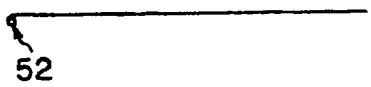
Fig. 5 (2)
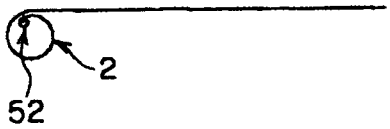
Fig. 5 (3)
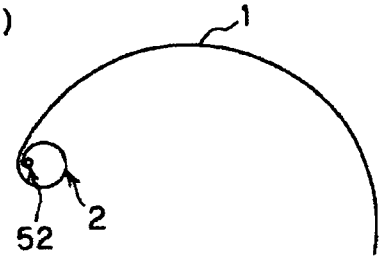
Fig. 5 (4)
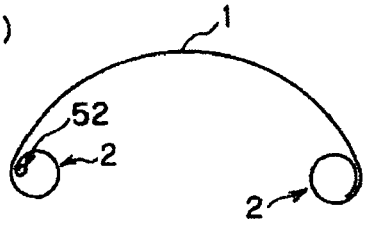
Fig. 5 (5)
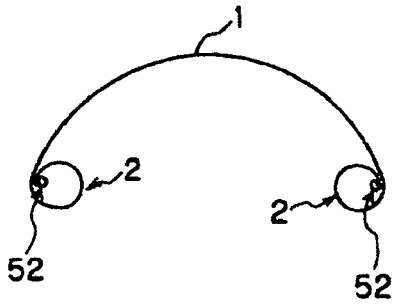
Fig. 5 (6) Heat treatment
Fig. 5 (7)
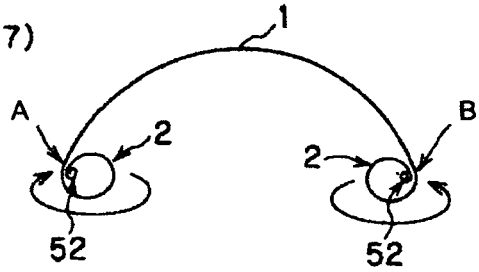
Fig. 5 (8)
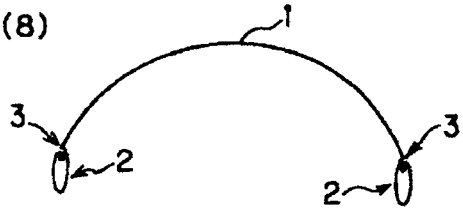
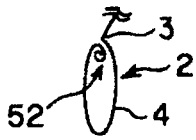

Fig. 6 (1)
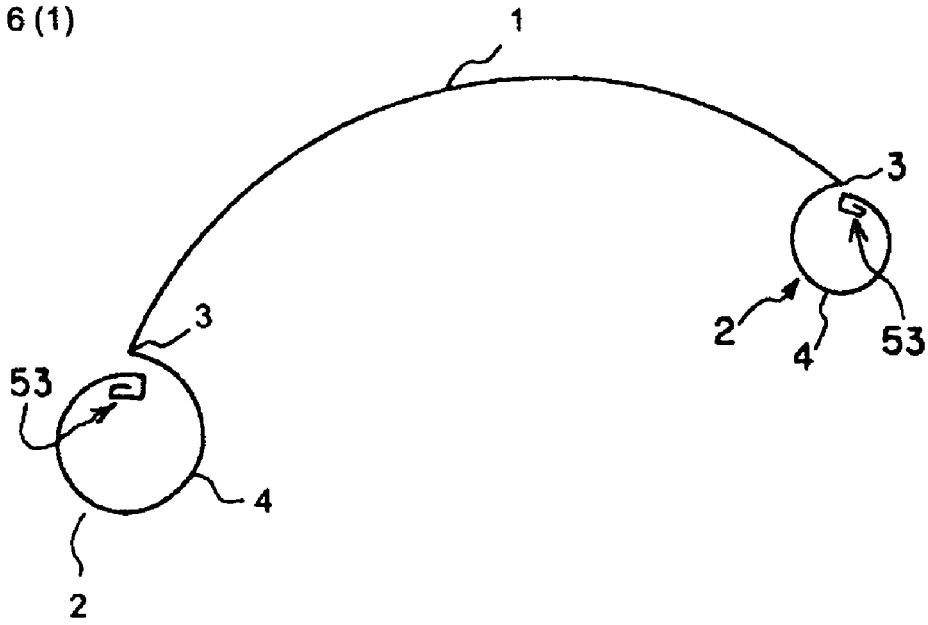
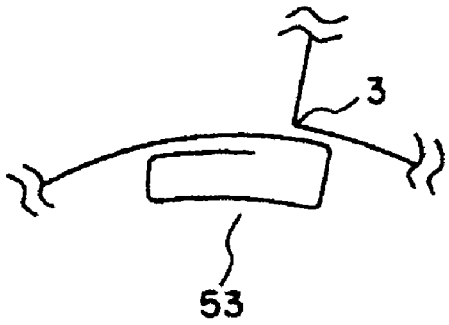
Fig. 6 (2)
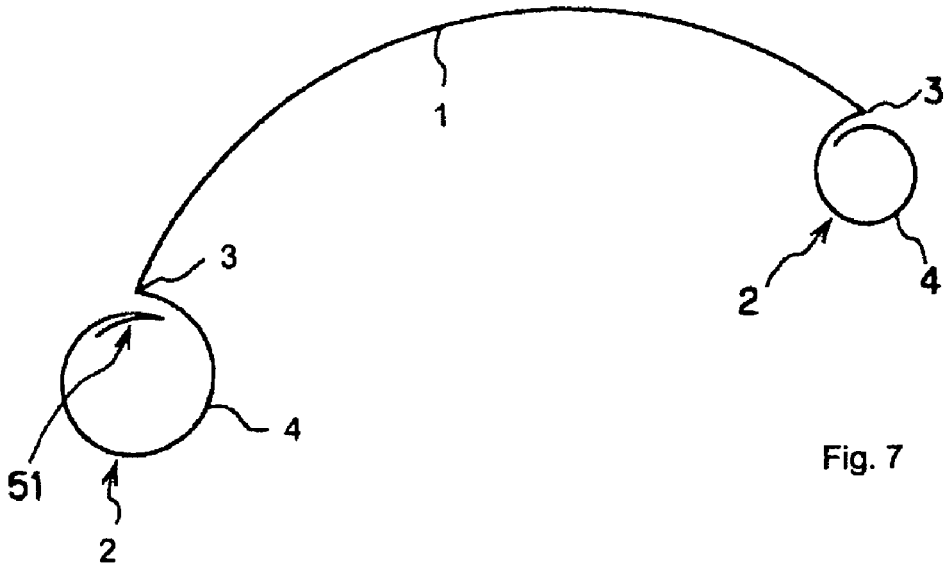
Fig. 7

| time | 0h | 250h | 500h | 750h | 1000h | 1250h |
|---|---|---|---|---|---|---|
| 1) | 0/20 | 0/20 | 3/20 | 9/20 | 13/20 | 14/20 |
| 2) | 0/20 | 0/20 | 0/20 | 0/20 | 0/20 | 0/20 |

1) conventional trigger wire 2) trigger wire of the invention

-number left of "/" is the number of trigger wires loosened during operation and thus unsuited -number right of "/" is the number of trigger wires tested

DISCHARGE LAMP OF THE SHORT ARC TYPE HAVING A TRIGGER WIRE

BACKGROUND OF THE INVENTION

1. Field of Invention

The invention relates to a discharge lamp of the short arc type which is used, for example, as the light source of a projector, and which is filled with xenon. The invention also relates to a discharge lamp of the short arc type which is used as a light source for semiconductor exposure and which is filled with mercury.

2. Description of Related Art

In a discharge lamp of the short arc type there is normally a trigger wire on the outside surface of the arc tube for reducing the breakdown voltage.

Japanese patent disclosure document JP SHO 51-78586 A discloses as a process for attachment of the trigger wire in a lamp a technique in which hermetically sealing parts which border the two ends of the arc tube are wound once with a trigger wire and in which the ends of the wound trigger wire are twisted with a tool and attached.

Furthermore, Japanese patent disclosure document JP 2002-367566 A (U.S. Pat. No. 6,657,383 B2) discloses a technique in which the following is done:

- A metal wire with a resilient property of stainless steel or the like is processed according to the shape of the arc tube in the form of an arc.
- Its two ends are formed into spring-like parts which correspond to the diameter of the hermetically sealing parts which extend from both ends of the arc tube.
- The spring-like parts are spread, the hermetically sealing parts are bridged with them and they are held by the inherent spring force of the spring-like parts.
- Thus, the trigger wire is slipped onto the arc tube and the hermetically sealing parts.

In the technique shown in Japanese patent disclosure document JP SHO 51-78586 A, the ends of the trigger wire are twisted with a tool and slipped on. Therefore, there is the danger that the twisting tool will come into contact with the glass surfaces of the hermetically sealing parts and the arc tube and will damage the glass surfaces. In a discharge lamp of the short arc type in which the inside of the arc tube during operation of the lamp reaches a high pressure, this damage causes the lamp to break. Since the twisting process is repeated several times, there is also the danger that the trigger wire will rub off the heat insulating film which is formed on the surfaces of the hermetically sealing parts and the arc tube, that the heat insulating film will come off and that the appearance of the lamp will be damaged.

In the trigger wire described in Japanese patent disclosure document JP 2002-367566 A (U.S. Pat. No. 6,657,383 B2), the time for installation of the trigger wire is shortened, by which workability is improved. However, if the duration of operation is lengthened, the trigger wire is exposed to a high temperature during this time. There are the disadvantages here that the resilience is lost and that the spring-like parts, as a result of the loosened shape, fall off of the hermetically sealing parts. When the trigger wire falls off the lamp, the function of the trigger wire which actually supports starting is lost.

As a countermeasure against loosening of the trigger wire of stainless steel as a result of a high temperature, it can be imagined that the wire diameter is increased. However, increasing the wire diameter causes the trigger wire to become hard. The work of installing the trigger wire is made difficult thereby and the actual purpose of shaping it beforehand into a resilient shape to improve workability is lost. The trigger wire, when hardened, furthermore, damages the glass surfaces of the hermetically sealing parts when the hermetically sealing parts are inserted into the elastic parts; this causes the lamp to break. A thick trigger wire in a lamp for semiconductor exposure also shields the light radiated from the lamp; this also hinders the uniformity of the illuminance of the irradiated surface.

As a countermeasure against loosening of the trigger wire of stainless steel as a result of a high temperature, it can be imagined that the wire material is changed. However, since the trigger wire, which is adjacent to the arc tube which reaches 500° C. to 750° C. during lamp operation in the atmosphere, is exposed to a high temperature, the selection of metal wires which have resistance over a long time at a high temperature and which are suited as a spring material is more and more limited. For example, platinum or the like is resistant to a high temperature and is therefore advantageous as an spring material. However, that platinum is expensive and easily burns through are disadvantages, and there are similar disadvantages.

SUMMARY OF THE INVENTION

The invention was devised to eliminate the above described disadvantages in the prior art. Thus, a primary object of the present invention is to devise a discharge lamp of the short arc type with a trigger wire which, when installed, does not damage the lamp, which can be easily installed and which is designed to be reliably held by the hermetically sealing parts even upon loss of resilience due to use of the lamp at a high temperature over a long time.

The above described object is achieved by the invention as follows.

In a first aspect of the invention for a discharge lamp of the short arc type which comprises the following:

- an arc tube in which there is a pair of electrodes opposite;
- a pair of hermetically sealing parts which extend to either side of the arc tube; and
- a trigger wire having two ends which are wound around a respective one of the hermetically sealing parts, and with a middle area which is located along the outside surface of the above described arc tube, the object is achieved by the above described trigger wire, at least on one of the hermetically sealing parts, has a bend which is formed between the middle area and the end, and a fold which is formed in the tip area of the above described end, that the above described bend adjoins the above described fold and that thus the trigger wire is slipped onto the hermetically sealing parts.

In accordance with a second aspect of the invention, in a discharge lamp of the short arc type according to the first aspect, this object is achieved in that, in vertical operation in which one of the two electrodes is located over the other, the trigger wire has the above described bend only on the side of the upper hermetically sealing part and the above described fold.

Since, in the invention described in the first aspect, in a discharge lamp of the short arc type which comprises the following:

- an arc tube in which there is a pair of electrodes opposite;
- a pair of hermetically sealing parts which extend to either side of the arc tube;
- a trigger wire with two ends which are wound around a respective one of the hermetically sealing parts, and with a middle area which is located along the outside surface of the above described arc tube, there is the measure that the trigger wire, at least on one of the hermetically sealing parts, has a bend which is formed between the above described middle area and the above described end, and a fold which is formed in the tip area of the above described end, that the above described bend adjoins the fold and that thus the trigger wire is slipped onto the hermetically sealing parts, there are the following advantages:

When the trigger wire is mounted in a discharge lamp of the short arc type, the lamp is not damaged, and installation takes place easily.

Even when the resilience is lost by use at a high temperature of the lamp over a long time and even when the wound parts loosen, the loosening of the wound parts is controlled so that they are not further loosened because the bend adjoins the fold. Thus, the trigger wire can be prevented from falling off and the trigger wire can be reliably held on the hermetically sealing parts.

In the invention described in the second aspect, there is the measure that, for vertical operation in which one of the electrodes is located at the top and the other is at the bottom, the trigger wire only on the side of the upper hermetically sealing part has the above described bend and the above described fold, and that the trigger wire is slipped onto the hermetically sealing parts in this way, the lamp can be reliably held even when the trigger wire is used at a high temperature over a long time, also if on the side of the lower hermetically sealing part the trigger wire is only wound once around the hermetically sealing part.

The invention is described in detail below with reference to the accompanying the drawings.

BRIEF DESCRIPTION OF THE DRAWINGS

FIGS. 1(1) and 1(2) each show a schematic of the arrangement of a first embodiment of a trigger wire which is slipped onto a discharge lamp of the short arc type according to the invention;

FIGS. 2(1) to 2(8) each show a schematic of the sequence of production of the trigger wire shown in FIGS. 1(1) and 1(2);

FIGS. 3(1) to 3(4) each show a schematic of a step in the sequence of installation of the trigger wire on a discharge lamp of the short arc type in accordance with the first embodiment of the invention;

FIGS. 4(1) and 4(2) each show a schematic of a second embodiment of the arrangement of the trigger wire which is slipped onto a discharge lamp of the short arc type as claimed in the invention;

FIGS. 5(1) to 5(8) each show a schematic of a step in the sequence of producing the trigger wire shown in FIGS. 4(1) and 4(2);

FIG. 6(1) shows a schematic of a third embodiment of the arrangement of the trigger wire which is slipped onto a discharge lamp of the short arc type in accordance with the invention with an enlarged detail thereof being shown in FIG. 6(2);

FIG. 7 shows a schematic of the arrangement of a fourth embodiment of the arrangement of the trigger wire which is slipped onto a discharge lamp of the short arc type according to the invention;

DETAILED DESCRIPTION OF THE INVENTION

Figures 8, 9:
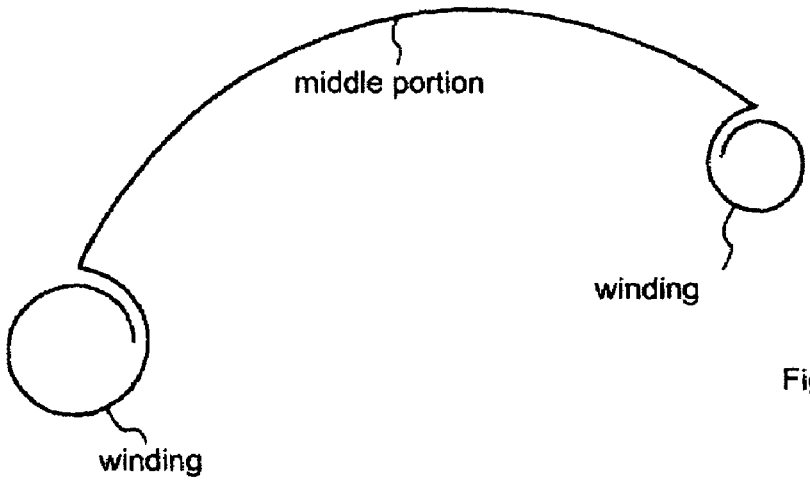
Fig. 9 (Prior Art)
FIG. 8 is a table for assessment of the loosening of the trigger wire from the lamp in the course of operation of the trigger wire in accordance with the invention and with the known trigger wire shown in FIG. 9.
FIG. 9 shows a schematic of a prior art trigger wire.

A first embodiment of the invention is described below using FIGS. 1(1), 1(2) to FIGS. 3(1) to 3(4).

FIG. 1(1) shows the arrangement of a trigger wire which is slipped onto the discharge lamp of the short arc type with FIG. 1(2) being an enlarged view of a bend 3 and a fold 51 and their vicinity as shown in FIG. 1(1).

In these figures, the middle area 1 of a trigger wire which is located along the outer surface of an arc tube of the short arc type and is arc-shaped. Each end 2 of the trigger wire is slipped onto a respective one of the hermetically sealing parts of the discharge lamp of the short arc type (not shown). A bend 3 is formed between the middle area 1 and the end 2. A fold 51 is kinked essentially in a V-shape in the tip area of the end 2.

FIG. 2(1) to 2(8) each schematically show a step in the sequence of producing the trigger wire shown in FIG. 1(1).

First, as shown in FIG. 2, a ring-shaped part is formed on end 2 of the trigger wire. Next, as shown in FIG. 2(2), the middle area 1 of the trigger wire is made arc-shaped. Afterwards, as shown in FIG. 2(3), the other end 2 of the trigger wire is formed into a ring-shape. Afterwards, as shown in FIG. 2(4), heat treatment is performed to fix the shape which has been formed as shown in FIG. 2(3). Then, as shown in FIG. 2(5), at the starting points A and B in the figure, the ends 2 are bent essentially by 90°. Afterwards, as shown in FIG. 2(6), at the starting points A and B, the ends 2 are bent essentially by 90°, by which a bend 3 is formed on the above described starting points A and B. Then, according to FIG. 2(7), the tip areas of the ends 2 are bent outward essentially by 180° at the starting points C and D in the figure, by which a respective fold 51 is formed, as is shown in an enlargement of the ends 2. As a result, as shown in FIG. 2(8), a trigger wire according to the first embodiment of the invention is obtained.

FIGS. 3(1) to 3(4) show the sequence of installation of a trigger wire according to the first embodiment of the invention in a discharge lamp of the short arc type. In FIGS. 3(1) to 3(4), the discharge lamp of the short arc type has an arc tube 6 with hermetically sealing parts 7.

First, as shown in FIG. 3(1), the discharge lamp of the short arc type is placed opposite the trigger wire in order to slip the trigger wire onto the discharge lamp of the short arc type. Next, the intermediate space between the bend 3 on one end 2 of the trigger wire and the fold 51, as is shown in FIG. 3(2), is spread, and this one end 2 is suspended on one of the hermetically sealing tubes 7. Next, the part of the bend 3 which has approached the middle area 1 is clamped into the fold 51 which is formed essentially in a V shape, as is shown in FIG. 3 (3).As a result, one end 2 is slipped onto one hermetically sealing part 7. Next, as is shown in FIG. 3(4), the same sequence as in FIGS. 3(2) and (3) is repeated and the other end 2 is slipped onto the other hermetically sealing part 7.

As was described above, when the trigger is attached to the lamp, the trigger wire can be easily installed without damage to the lamp by the trigger wire in the embodiment of the invention, and furthermore, it can be reliably held on the hermetically sealing parts even if the resilience of the trigger wire is lost by use at a high temperature of the lamp over a long time.

A second embodiment of the invention is described below using FIGS. 4(1), 4(2) and 5(1) to 5(8). FIG. 4(1) is a schematic of the arrangement of a trigger wire which is slipped onto a discharge lamp of the short arc type according to this embodiment of the invention. FIG. 4(2) is an enlargement of the bend 3 and the fold 52 and their vicinity which are shown in FIG. 4(1). In this embodiment, the fold is a small, annular fold 52 which is formed in the tip area of the end 2 of the trigger wire. The remaining arrangement is identical to the arrangement shown in FIGS. 1(1) and 1(2), and therefore, is provided with the same reference numbers. As a result, it is not further described.

FIGS. 5(1) to 5(8) each schematically show the sequence of production of the trigger wire shown in FIG. 4(1). First, as shown in FIG. 5(1), a small annular fold 52 is formed on the tip area of one end 2 of the trigger wire. Next, as shown in FIG. 5(2), a ring-shaped part is formed on one end 2 of the trigger wire. Thereupon, as shown in FIG. 5(3) the middle area 1 of the trigger wire is formed into an arc-shape. Next, as shown in FIG. 5(4), the other end 2 of the trigger wire is made ring-shaped. Next, as shown in FIG. 5(5), a small annular fold 52 is formed on the other end 2 of the trigger wire. Then, as shown in FIG. 5(6), heat treatment is performed to set the shape which was formed as shown in FIG. 5(5). Next, as shown in FIG. 5(7), at the starting points A and B in the figure, the ends 2 are twisted essentially 90°. Afterwards, as shown in FIG. 5(8), at the starting points A and B, the ends 2 are bent essentially by 90°, by which a respective bend 3 is formed at each of the above described starting points A and B. As a result, a trigger wire according to the second embodiment of the invention is obtained.

The sequence of installation of a trigger wire according to the second embodiment of the invention in a discharge lamp of the short arc type is not shown in the drawings. However, it is essentially identical to the installation sequence which shown in FIG. 3(1) to 3(4) for the first embodiment. The sequence shown in FIGS. 3(3) and 3(4) differs in that the small annularly made fold 52 is hooked onto the part of the bend 3 near the middle area. However, the two are identical to one another in the sense of slipping the two ends 2 of the trigger wire onto the hermetically sealing parts 7.

For the trigger wire in this embodiment of the invention, when the trigger wire is mounted, it can be easily installed in the lamp without damaging the latter and can be reliably held on the hermetically sealing parts even if the resilience of the trigger wire is lost due to use at a high temperature of the lamp over a long time.

A third embodiment of the invention is described below with reference to FIGS. 6(1) and 6(2).

FIG. 6(1) shows a schematic of the arrangement of the trigger wire which can be slipped onto the discharge lamp of the short arc type in accordance with another embodiment of the invention. FIG. 6(2) is an enlargement the area of the bend 3 and of the fold 53 which are shown in FIG. 6(1).

In this embodiment, the fold is a fold 53 which has been formed on the tip area of the end 2 of the trigger wire essentially in the shape of a small square. The arrangement otherwise is identical to the arrangement shown in FIGS. 1(1) and 1(2) and is provided with the same reference numbers. Therefore, it need not be further described.

The sequence of production of the trigger wire according to the embodiment of the invention is not shown in the drawings; however, it is essentially identical to the sequence of production which was shown in FIGS. 2(1) to 2(8) for the first embodiment. The sequence of production which is shown starting with FIG. 2(7) differs in that the fold 53 at the tip area of the end 2 is formed essentially in the shape of a small square.

The sequence of installation of the trigger wire according to the embodiment of the invention in the discharge lamp of the short arc type is not shown in the drawings; however, it is essentially identical to the installation sequence which is shown in FIG. 3(1) to 3(4) in the first embodiment. The sequence shown in FIGS. 3(3) and 3(4) differs in that the fold 53 which was formed essentially in the shape of a small square is hooked onto the area of the bend 3 near the middle area, like the case for the second embodiment. On the other hand, the installation is identical to the first embodiment in the sense of slipping the ends 2 of the trigger wire onto a respective one of the hermetically sealing parts 7.

For the trigger wire in this embodiment of the invention, when the trigger wire is mounted, it can be easily installed on the lamp without damaging the latter and can be reliably held on the hermetically sealing parts even if the resilience of the trigger wire is lost at a high temperature of the lamp over a long time.

A fourth embodiment of the invention is described below with reference to FIG. 7 which is a schematic of the arrangement of a trigger wire which is slipped onto the discharge lamp of the short arc type according to a fourth embodiment of the invention.

The trigger wire of this embodiment of the invention has a fold 51 formed on one of the ends 2 which are formed on the two ends of the trigger wire. On the other end 2, only a turn 4 is formed which is wound around the hermetically sealing part, and not a fold 51. The arrangement otherwise is identical to the arrangement shown in FIGS. 1(1) and 1(2) and is provided with the same reference numbers, and therefore, need not be further described. Furthermore, instead of the fold 51, the types of folds 52, 53 shown in the second and third embodiments can also be used.

In vertical operation in which one of the electrodes in the arc tube is located at the top and the other at the bottom, this trigger wire is slipped onto the hermetically sealing part that is the upper hermetically sealing part, the bend 3 being hooked in the fold 51. On the lower hermetically sealing part, the turn 4 is wound once around the hermetically sealing part. In vertical operation, by this arrangement of the trigger wire, the latter can also be reliably held even when used at a high temperature of the lamp over a long time.

FIG. 8 is a table for assessment of the loosening of the trigger wire of the lamp over the course of operation of the trigger wire for the respective embodiment of the invention and of the prior art trigger wire shown in FIG. 9. As the table clearly shows, it was confirmed that the prior art trigger wire gradually detached from the lamp starting from the instant after passage of 500 hours. It has been confirmed for the trigger wire in accordance with the invention that the trigger wire did not loosen from the lamp even after 1250 hours, and that the invention is excellent for slipping the trigger wire onto the lamp.

FIG. 9 is a schematic of the arrangement of the trigger wire in the prior art which was produced for assessment of the loosening of the trigger wire from the lamp over the course of operation. As shown in FIG. 9, for the turns which are formed on the two ends of the trigger wire, this trigger wire is wound around the hermetically sealing part and is located in the middle area along the outside surface of the arc tube. However, it does not have any slip-on means like the trigger wire in the embodiments of the invention which suspends the bends on the folds and by which slipping onto the hermetically sealing parts takes place.

What we claim is:

1. Discharge lamp of the short arc type which comprises:

an arc tube in which there is a pair of opposed electrodes;

a pair of hermetically sealing parts which extend outward from opposite ends of the arc tube;

a trigger wire, each end of which has a bend that is wound around a respective one of the hermetically sealing parts, and which has a middle area which runs along an outside surface of the arc tube, wherein, in the area of at least one of the ends of the trigger wire, the bend comes to rest on one of the hermetically sealing parts, and adjoining this bend, a tip end area of the end of the trigger wire has a fold in which the bend is hooked for mounting of the bend around a respective hermetically sealing part.

2. Discharge lamp of the short arc type as claimed in claim 1, wherein the fold accommodates a section of the trigger wire in itself so that a closed loop extends around the hermetically sealing part.

3. Discharge lamp of the short arc type as claimed in claim 1, wherein the fold is helically curved.

4. Discharge lamp of the short arc type as claimed in claim 1, wherein a fold is provided on each of the ends of the trigger wire.

5. Discharge lamp of the short arc type as claimed in claim 1, wherein there is a fold only on one end of the trigger wire.

6. Discharge lamp of the short arc type as claimed in claim 5, wherein the fold is on a side of that hermetically sealing part which is located at the top in vertical operation of the lamp.

7. Discharge lamp of the short arc type as claimed in claim 1, wherein at least a portion of the fold of the trigger wire extends parallel to and in an opposite direction relative to a portion of the trigger wire forming said bend at an opposite side of said fold from said portion.

8. Discharge lamp of the short arc type as claimed in claim 1, wherein the fold is essentially V-shaped and substantially smaller than the bend.

9. Discharge lamp of the short arc type as claimed in claim 1, wherein the fold is essentially square-shaped and substantially smaller than the bend.

10. Discharge lamp of the short arc type as claimed in claim 1, wherein the fold is essentially ring-shaped and substantially smaller than the bend.

* * * * *